US010478743B1

(12) United States Patent
Zhang et al.

(10) Patent No.: US 10,478,743 B1
(45) Date of Patent: Nov. 19, 2019

(54) AUDIO-LIGHTING CONTROL SYSTEM

(71) Applicant: GEMMY INDUSTRIES CORPORATION, Coppell, TX (US)

(72) Inventors: Cheng-Chun Zhang, Shenzhen (CN); Lio Yenwei Chang, Coppell, TX (US)

(73) Assignee: GEMMY INDUSTRIES CORPORATION, Coppell, TX (US)

( * ) Notice: Subject to any disclaimer, the term of this patent is extended or adjusted under 35 U.S.C. 154(b) by 0 days.

(21) Appl. No.: 16/137,098

(22) Filed: Sep. 20, 2018

(51) Int. Cl.
*G10H 1/00* (2006.01)
*A63J 17/00* (2006.01)
*H05B 37/02* (2006.01)

(52) U.S. Cl.
CPC ..... *A63J 17/00* (2013.01); *H05B 37/0236* (2013.01); *H05B 37/0272* (2013.01); *H05B 37/0281* (2013.01)

(58) Field of Classification Search
CPC ..... G10H 2240/211; G10H 1/0058; G10H 2240/131; G10H 1/0066; G10H 2220/021; G10H 2220/061
See application file for complete search history.

(56) References Cited

U.S. PATENT DOCUMENTS 7,786,371 B1 * 8/2010 Moates ..... G10H 1/0066 84/464 R
8,604,328 B2 * 12/2013 De Waele ..... A63J 17/00 84/615
9,826,298 B2 * 11/2017 Sun ..... H04R 1/028
2006/0144213 A1 * 7/2006 Mann ..... G10H 1/0008 84/724
2007/0137462 A1 * 6/2007 Barros ..... G10H 1/0058 84/453

* cited by examiner

*Primary Examiner* — Marlon T Fletcher
(74) *Attorney, Agent, or Firm* — Rabin & Berdo, P.C.

(57) ABSTRACT

Provided is an audio-lighting control system, including a first device and a second device. The first device includes an audio module, which generates audio data and plays music accordingly; a first processor unit is electrically connected to the audio module and generates a lighting control signal. The second device is wirelessly connected to the first device through a wireless transmission device and the second device receives the lighting control signal from the first device, while the second device displays lighting effects according to the lighting control signal. The wireless transmission device is wirelessly connected to the first device and the second device through standard 2.4 GHz wireless communication. The audio-lighting control system achieves the goals of displaying music and lighting simultaneously, and reducing the cost of setting up the system.

9 Claims, 5 Drawing Sheets

AUDIO-LIGHTING CONTROL SYSTEM

BACKGROUND OF THE INVENTION

1. Field of the Invention

The present invention relates to a control system, and more particularly to an audio-lighting control system.

2. Description of the Related Art

A display system that provides music broadcasting and lighting effects simultaneously is often applied in numerous entertaining systems or stage performances. Moreover, to make the lighting effects work in line with the music played, it is also common to set up a detecting module to detect the tempo, rhythm, or volume, etc. of the music, and produce a lighting control signal according to the detection outcome, thereby controlling the colors, on-off orders, and rhythms of multiple lighting devices. In order to set up such a performing system in a wide space, short range wireless transmission modules such as Wi-Fi module, Bluetooth module, or ZigBee module are usually installed in the lighting devices to receive the lighting control signal, thus achieving the goal of controlling the lighting devices according to the music being played.

However, to equip multiple lighting devices with the Wi-Fi module, Bluetooth module, or ZigBee module can be quite costly; therefore, the conventional display system needs to be improved.

SUMMARY OF THE INVENTION

An objective of the present invention is to provide an audio-lighting control system.

To achieve the foregoing objective, the audio-lighting control system includes a first device, a second device, and a wireless transmission device. The first device includes an audio module, a first processor unit, and a first wireless module. The audio module generates an audio data and plays music according to the audio data. The first processor unit is electrically connected to the audio module, and the first processor unit generates a lighting control signal. The first wireless module is electrically connected to the first processor unit. The wireless transmission device is wirelessly connected to the first wireless module of the first device, and receives the lighting control signal from the first device. The second device includes a second wireless module and a lighting module, while the second wireless module is wirelessly connected to the wireless transmission device, and the lighting module is electrically connected to the second wireless module. The second wireless module receives the lighting control signal from the wireless transmission device, and the lighting module receives the lighting control signal and displays lighting effects according to the lighting control signal.

The wireless transmission device is wirelessly connected to the first wireless module and the second wireless module through 2.4 GHz wireless communication.

The first processor unit of the first device generates the lighting control signal and transmits the lighting control signal to the second device through the wireless transmission device, wherein the lighting module of the second device displays lighting effects along with the music played by the first device. The second device requires only a 2.4 GHz communication module that is cheaper compared to other wireless communication modules such as Wi-fi module, Bluetooth module, or ZigBee module. The control system of the present invention is of much lower cost than the conventional display system, while still effectively provides music and lighting effects simultaneously.

Other objectives, advantages and novel features of the invention will become more apparent from the following detailed description when taken in conjunction with the accompanying drawings.

DETAILED DESCRIPTION OF THE INVENTION

Figure 1:
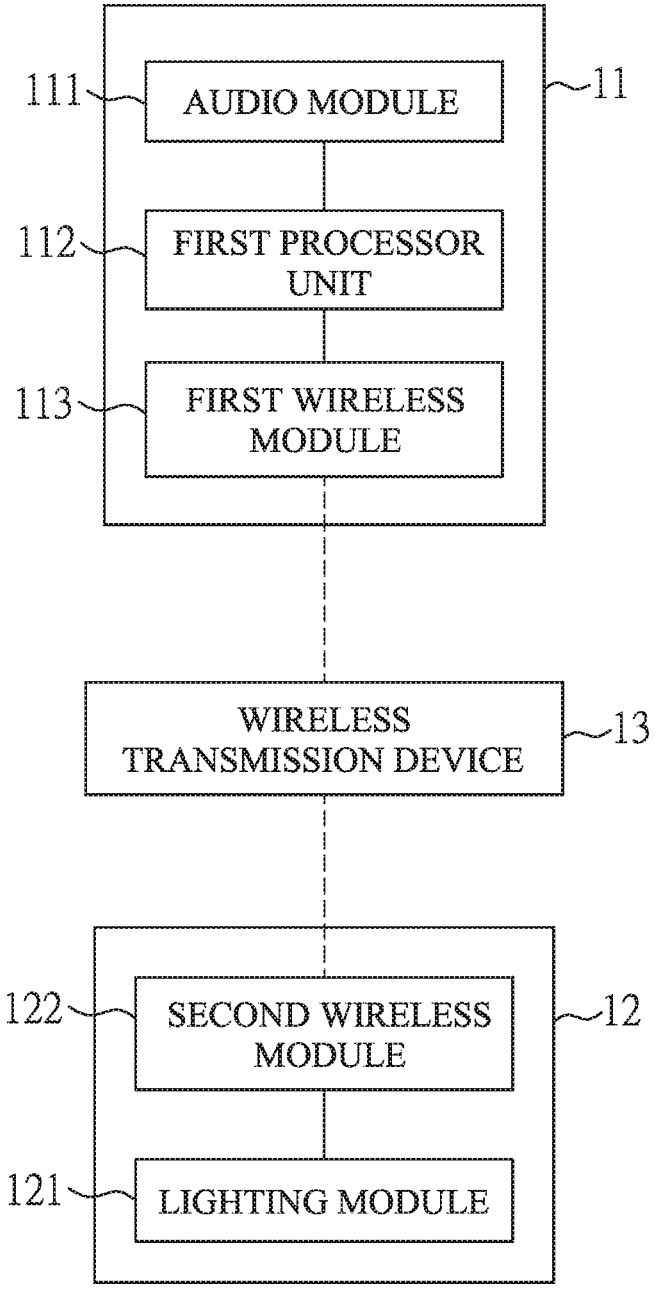
FIG. 1 is a schematic view of an audio-lighting control system of the present invention.

With reference to FIG. 1, an audio-lighting control system of the present invention includes a first device 11, a second device 12 and a wireless transmission device 13. The first device 11 includes an audio module 111, a first processor unit 112, and a first wireless module 113. The audio module 111 generates audio data and plays music according to the audio data. The first processor unit 112 is electrically connected to the audio module 111, and the first processor unit 112 generates a lighting control signal. The first wireless module 113 is electrically connected to the first processor unit 112. The wireless transmission device 13 is wirelessly connected to the first wireless module 113 of the first device 11, and receives the lighting control signal from the first device 11. The second device 12 includes a lighting module 121 and a second wireless module 122, while the second wireless module 122 is wirelessly connected to the wireless transmission device 13, and the lighting module 121 is electrically connected to the second wireless module 122. The second wireless module 122 receives the lighting control signal from the wireless transmission device 13, and the lighting module 121 receives the lighting control signal and displays lighting effects according to the lighting control signal.

The wireless transmission device 13 is wirelessly connected to the first wireless module 113 and the second wireless module 122 through 2.4 GHz wireless communication. The first processor unit 112 of the first device 11 generates the lighting control signal and transmits the lighting control signal to the second device 12 through the wireless transmission device 13, wherein the lighting module 121 of the second device 12 displays lighting effects along with the music played by the first device 11. The second device 12 requires only a 2.4 GHz communication module to receive the lighting control signal. Since the 2.4 GHz communication module is cheaper compared to other wireless communication modules such as Wi-fi module, Bluetooth module, or ZigBee module, the control system of the present invention is of much lower cost than a conventional display system, while still effectively provides music and lighting effects simultaneously.

Preferably, the first wireless module 113 of the first device 11, the second wireless module 122 of the second device 12, and the wireless transmission device 13 are communicating through a 2.4 GHz communication protocol. As IEEE Standard protocols such as Wi-fi, Bluetooth or Zigbee are designed to perform high load of data transmission and build complicated network and therefore require complicated data protocols, using the 2.4 GHz communication protocol is not only cost-effective but also reduces the reaction time of the system, and thus prevents time delay between the reaction of the first device 11 and the second device 12. As a result, the audio-lighting control system has a fast response between the first device 11 and the second device 12, achieving the main purpose of controlling the music and the lighting effects to display simultaneously and well synchronized.

Figure 2:
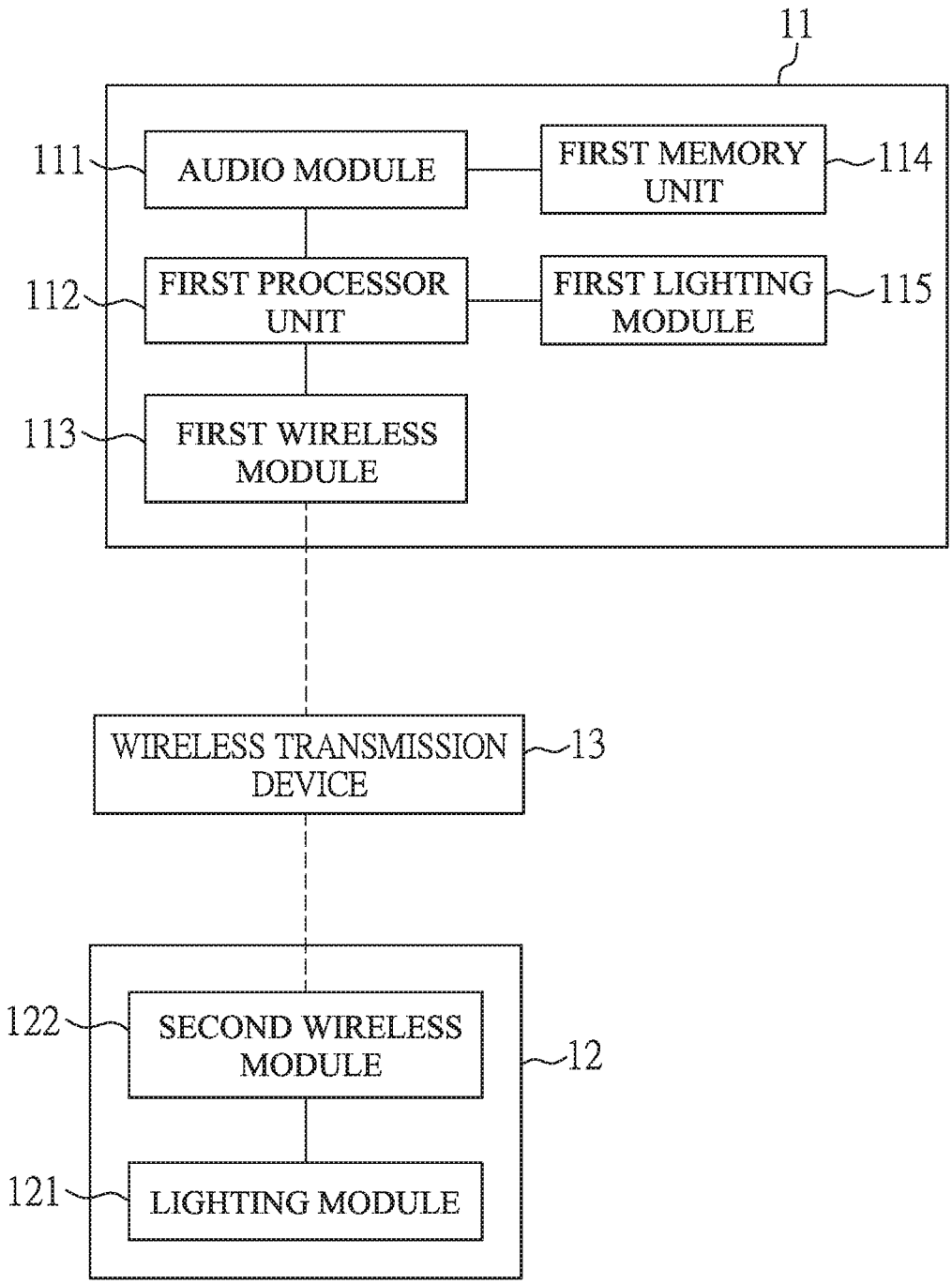
FIG. 2 is a schematic view of a first embodiment of the audio-lighting control system of the present invention.

With reference to FIG. 2, in a first embodiment of the present invention, the first device 11 further includes a first memory unit 114, and a first music file is stored in the first memory unit 114. The first memory unit 114 is electrically connected to the audio module 111, while the audio module 111 receives the first music file and generates the audio data according to the first music file.

Preferably, the first processor unit 112 generates the lighting control signal according to the audio data. For instance, the first processor unit 112 detects the rhythm, tempo, or volume of the music that is played with the audio data and generates the lighting control signal according to the detection outcome. Therefore, by receiving the lighting control signal, the lighting module 121 displays lighting effects that match the music by displaying different colors, frequencies, or intensities of lights.

Preferably, the first device 11 further includes a first lighting module 115. The first lighting module 115 is electrically connected to the first processor unit 112 and receives the lighting control signal from the first processor unit 112, while the first lighting module 115 displays lighting effects according to the lighting control signal. The first device 11 and the second device 12 are both equipped with a lighting module, while the second device 12 receives the lighting control signal wirelessly through the wireless transmission device 13, and both the first lighting module 115 of the first device 11 and the lighting module 121 of the second device 12 display lighting effects according to the lighting control signal at the same time, providing an even more vivid performance.

Figure 3:
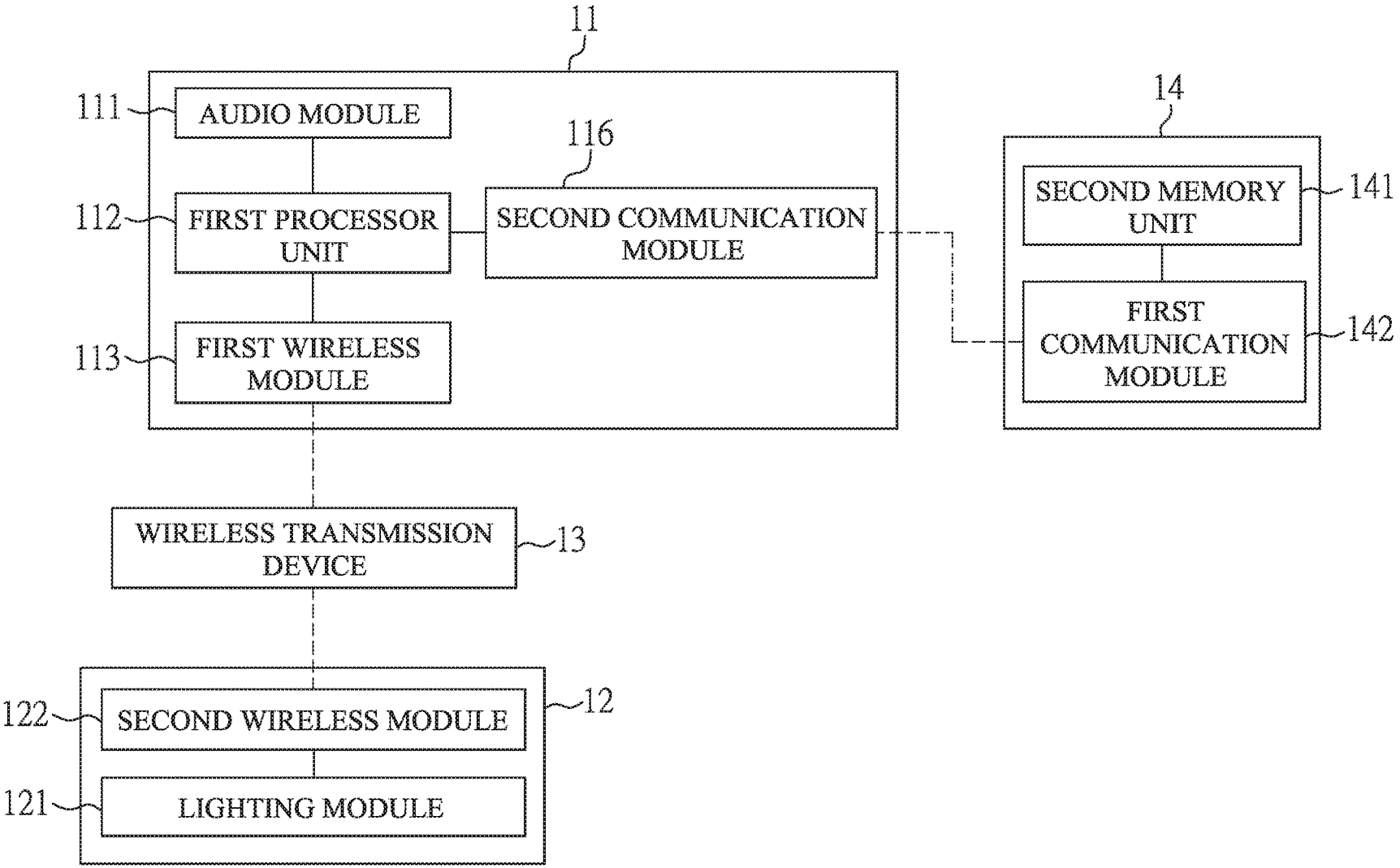
FIG. 3 is a schematic view of a second embodiment of the audio-lighting control system of the present invention.

With reference to FIG. 3, in a second embodiment of the present invention, the audio-lighting control system further includes an audio device 14. The audio device 14 includes a second memory unit 141 and a first communication module 142. A second music file is stored in the second memory unit 141. The first communication module 142 is electrically connected to the second memory unit 141, and the first communication module 142 loads the second music file from the second memory unit 141, and transmits the second music file wirelessly. The first device 11 further includes a second communication module 116, which is electrically connected to the first processor unit 112. The second communication module 116 is wirelessly connected to the first communication module 142 to receive the second music file, and further transmits the second music file to the first processor unit 112, while the audio module 111 receives the second music file from the first processor unit 112 and generates the audio data according to the second music file. Preferably, the audio device 14 is a mobile device, a smart phone, a tablet, or a personal computer. Preferably, the audio device 14 can connect to the Internet and downloads the second music file from the Internet. Preferably, the first communication module 142 and the second communication module 116 are Bluetooth modules.

In the embodiment, the audio-lighting control system further includes the audio device 14, which is wirelessly connected to the first device 11 and thus controls the playing of the music by transmitting the second music file to the first device 11. The first device 11 then further generates the lighting control signal according to the audio data, and sends the lighting control signal to the second device 12 in order to control the lighting module 121 of the second device 12. Since the audio device 14 is wirelessly connected to the first device 11 through wireless communication modules such as Bluetooth modules, a user is able to control the audio-lighting control system by operating the audio device 14 remotely, further improves the convenience and adaptability of the audio-lighting control system.

Figure 4:
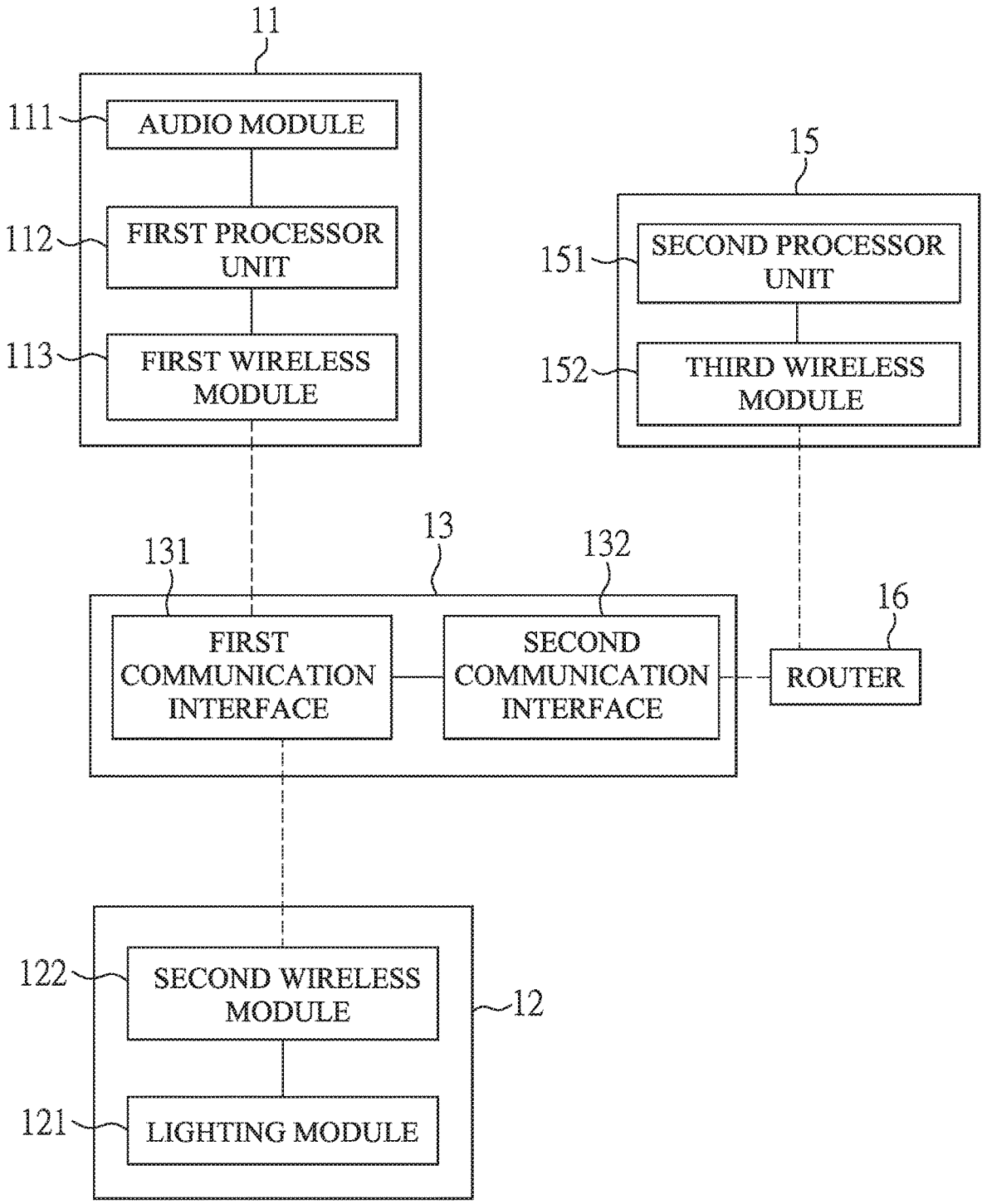
FIG. 4 is a schematic view of a third embodiment of the audio-lighting control system of the present invention.

With reference to FIG. 4, in a third embodiment of the present invention, the audio-lighting control system further includes a main control device 15 and a router 16. The wireless transmission device 13 includes a first communication interface 131 and a second communication interface 132, while the first communication interface 131 is electrically connected to the second communication interface 132. The wireless transmission device 13 is wirelessly connected to the first device 11 and the second device 12 by the first communication interface 131, that is, the first communication interface 131 is wirelessly connected to the first wireless module 113 of the first device 11 and the second wireless module 122 of the second device 12. The main control device 15 includes a second processor unit 151 and a third wireless module 152. The second processor unit 151 generates a function control signal, and the third wireless module 152 is electrically connected to the second processor unit 151 to receive the function control signal. The third wireless module 152 is wirelessly connected to the router 16, and the router 16 is further wirelessly connected to the second communication interface 132 of the wireless transmission device 13. The second communication interface 132 receives the function control signal from the third wireless module 152 through the router 16, while the first communication interface 131 receives the function control signal and further transmits the function control signal to the first wireless module 113 of the first device 11. As the first device 11 receives the function control signal, the first processor unit 112 controls the audio module 111 according to the function control signal, or generates the lighting control signal according to the function control signal. For example, when the function control signal contains a pause order, the first processor unit 112 controls the audio module 111 to pause the music, and the first processor unit 112 stops generating the lighting control signal, thereby pausing the playing/displaying of both the music and the lighting; when the function control signal contains an amplification order, the first processor unit 112 controls the audio module 111 to increase the volume of music, and generates the lighting control signal with a heightening order to brighten up the lighting effects.

However, in another embodiment, the second processor unit 151 generates an audio-lighting control signal. As the second communication interface 132 of the wireless transmission device 13 receives the audio-lighting control signal from the third wireless module 152 through the router 16, the first communication interface 131 receives the audio-lighting control signal and further transmits the audio-lighting control signal to the first wireless module 113 of the first device 11 and the second wireless module 122 of the second device 12. As a result, the main control device 15 controls the lighting module 121 of the second device 12 with the audio-lighting control signal, and when the first device 11 receives the audio-lighting control signal, the first processor unit 112 controls the audio module 111 according to the audio-lighting control signal. For instance, the audio-lighting control signal contains a pause order, an amplification order, or a diminishing order, such that the audio of the first device 11 and the lighting effects of the second device 12 perform audio and lighting effects that match.

Preferably, the main control device 15 is a mobile device, a smart phone, a tablet or a personal computer. Furthermore, the third wireless module 152 of the main control device 15 and the second communication interface 132 of the wireless transmission device 13 are both communication modules operating according to the IEEE 802.11 Wi-fi standard.

As a result, the user can control and adjust the performing of the music and light effects synchronized. Since the main control device 15 is connected to the wireless transmission device 13 through the router 16 with Wi-fi connection, which has a far longer distance of transmission than Bluetooth or 2.4 GHz wireless communication, a user is able to operate the first device 11 and the second device 12 remotely from a faraway location.

Figure 5:
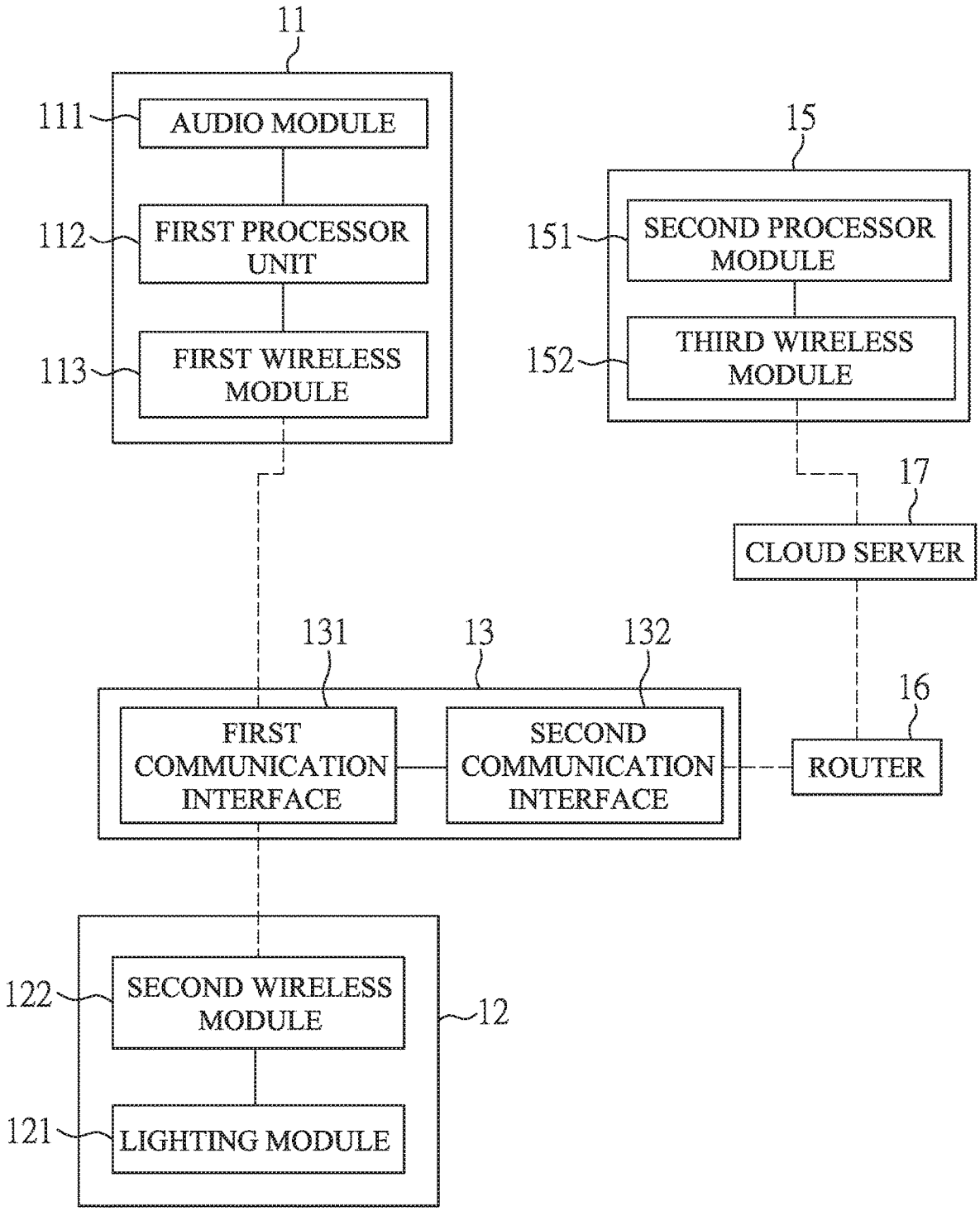
FIG. 5 is a schematic view of a fourth embodiment of the audio-lighting control system of the present invention.

With reference to FIG. 5, in a fourth embodiment of the present invention, the audio-lighting control system further includes a cloud server 17, which is wirelessly connected between the router 16 and the third wireless module 152 of the main control device 15. That is, the router 16 can communicate with the third wireless module 152 of the main control device 15 through the cloud server 17.

Since the main control device 15 is connected to the router 16 through the cloud server 17 and therefore connected to the wireless transmission device 13, the distance between the main control device 15 and the wireless transmission device 13 is not limited. Namely, no matter where the main control device 15 is, when the main control device 15 can connect to the cloud server 17, the main control device 15 can communicate with the first device 11 and the second device 12. That is, a user can operate the first device 11 and the second device 12 from anywhere as long as the main control device 15 can connect to the cloud server 17, thus further improving the convenience and the adaptability of the audio-lighting system.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An audio-lighting control system, comprising:

a first device, comprising an audio module, the audio module generating audio data, wherein the audio module plays music according to the audio data;

a first processor unit, electrically connected to the audio module, wherein the first processor unit generates a lighting control signal; and a first wireless module, electrically connected to the first processor unit, wherein the first wireless module receives the lighting control signal from the first processor unit;

a wireless transmission device, wirelessly connected to the first wireless module of the first device, and receiving the lighting control signal from the first wireless module;

a second device, comprising a second wireless module, wirelessly connected to the wireless transmission device, wherein the second wireless module receives the lighting control signal from the wireless transmission device; and a lighting module, electrically connected to the second wireless module and receiving the lighting control signal, wherein the lighting module displays lighting effects according to the lighting control signal; wherein the wireless transmission device is wirelessly connected to the first wireless module and the second wireless module through 2.4 GHz wireless communication;

a main control device, comprising a second processor unit, wherein the second processor unit generates a function control signal; and a third wireless module, electrically connected to the second processor unit, wherein the third wireless module receives the function control signal from the second processor unit; and a router, wirelessly connected to the third wireless module; wherein the wireless transmission device comprises a first communication interface, wirelessly connected to the first wireless module of the first device and the second wireless module of the second device; and a second communication interface, electrically connected to the first communication interface, and wirelessly connected to the router; wherein the second communication interface of the wireless transmission device receives the function control signal of the main control device through the connection of the router, and the first communication interface receives the function control signal and sends the function control signal to the first wireless module of the first device; and wherein when the first device receives the function control signal, the first processor unit controls the audio module to play the music according to the function control signal, or generates the lighting control signal according to the function control signal.

2. The audio-lighting control system as claimed in claim 1, wherein the first device further comprises a first memory unit, electrically connected to the audio module, wherein the first memory unit stores a first music file; and wherein the audio module generates the audio data according to the first music file.

3. The audio-lighting control system as claimed in claim 1, wherein the first processor unit generates the lighting control signal according to the audio data.

4. The audio-lighting control system as claimed in claim 1, wherein the first device further comprises a first lighting module, electrically connected to the first processor unit, wherein the first lighting module receives the lighting control signal from the first processor unit and displays lighting effects according to the lighting control signal.

5. The audio-lighting control system as claimed in claim 1, further comprising:

an audio device, comprising a second memory unit, wherein the second memory unit stores a second music file; and a first communication module, electrically connected to the second memory unit and loading the second music file from the second memory unit;

wherein the first device further comprises a second communication module, electrically connected to the first processor unit, and wirelessly connected to the first communication module of the audio device; wherein the second communication module loads the second music file from the first communication module, and transmits the second music file to the first processor unit; and wherein the audio module receives the second music file from the first processor unit and generates the audio data according to the second music file.

6. The audio-lighting control system as claimed in claim 5, wherein the first communication module and the second communication module are Bluetooth communication modules.

7. The audio-lighting control system as claimed in claim 1, comprising:

a cloud server, wherein the router is wirelessly connected to the third wireless module of the main control device through the cloud server.

8. The audio-lighting control system as claimed in claim 3, wherein the third wireless module of the main control device and the second communication interface of the wireless transmission device are Wi-fi communication modules.

9. An audio-lighting control system, comprising:

a first device, comprising an audio module, the audio module generating audio data, wherein the audio module plays music according to the audio data;

a first processor unit, electrically connected to the audio module, wherein the first processor unit generates a lighting control signal; and a first wireless module, electrically connected to the first processor unit, wherein the first wireless module receives the lighting control signal from the first processor unit;

a wireless transmission device, wirelessly connected to the first wireless module of the first device, and receiving the lighting control signal from the first wireless module;

a second device, comprising a second wireless module, wirelessly connected to the wireless transmission device, wherein the second wireless module receives the lighting control signal from the wireless transmission device; and a lighting module, electrically connected to the second wireless module and receiving the lighting control signal, wherein the lighting module displays lighting effects according to the lighting control signal; wherein the wireless transmission device is wirelessly connected to the first wireless module and the second wireless module through 2.4 GHz wireless communication;

a main control device, comprising a second processor unit, wherein the second processor unit generates an audio-lighting control signal; and a third wireless module, electrically connected to the second processor unit, wherein the third wireless module receives the audio-lighting control signal from the second processor unit; and a router, wirelessly connected to the third wireless module; wherein the wireless transmission device comprises a first communication interface, wirelessly connected to the first wireless module of the first device and the second wireless module of the second device; and a second communication interface, electrically connected to the first communication interface, and wirelessly connected to the router; wherein the second communication interface of the wireless transmission device receives the audio-lighting control signal of the main control device through the connection of the router, and the first communication interface receives the audio-lighting control signal and sends the audio-lighting control signal to the first wireless module of the first device and the second wireless module of the second device; wherein the main control device controls the lighting module of the second device with the audio-lighting control signal; and wherein when the first device receives the audio-lighting control signal, the first processor unit controls the audio module to play the music according to the audio-lighting control signal.

* * * * *